US007929888B2

(12) United States Patent
Shin

(10) Patent No.: US 7,929,888 B2
(45) Date of Patent: Apr. 19, 2011

(54) DEVELOPING UNIT AND IMAGE FORMING APPARATUS EMPLOYING THE SAME

(75) Inventor: Kyu-cheol Shin, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 557 days.

(21) Appl. No.: 12/014,941

(22) Filed: Jan. 16, 2008

(65) Prior Publication Data

US 2008/0304873 A1 Dec. 11, 2008

(30) Foreign Application Priority Data

Jun. 7, 2007 (KR) ..... 10-2007-0055629

(51) Int. Cl.
*G03G 15/09* (2006.01)

(52) U.S. Cl. ..... 399/277; 399/104; 399/276; 399/356

(58) Field of Classification Search ..... 399/103, 399/104, 277, 276, 356
See application file for complete search history.

(56) References Cited

U.S. PATENT DOCUMENTS

| | | | | |
|---|---|---|---|---|
| 4,246,867 | A * | 1/1981 | Hudson | 399/269 |
| 2003/0103783 | A1 * | 6/2003 | Nishimura et al. | 399/277 |
| 2006/0198655 | A1 * | 9/2006 | Kotera et al. | 399/104 |
| 2009/0154962 | A1 * | 6/2009 | Kotera et al. | 399/276 |

* cited by examiner

*Primary Examiner* — David P Porta
*Assistant Examiner* — Casey Bryant
(74) *Attorney, Agent, or Firm* — Stanzione & Kim, LLP

(57) ABSTRACT

A developing unit which forms an image on a photosensitive medium, includes a housing which accommodates a developer, a magnetic cylinder having a catch pole which picks up the developer in the housing by a magnetic force, and a main pole which couples a carrier among the picked-up developer, a sleeve rotatably installed on a circumference of the magnetic cylinder to form a magnetic brush having a predetermined width on the circumference by the developer picked up by the catch pole, and a sealing member provided at opposite end parts in an axial direction of the sleeve to prevent a leak of the developer, wherein a width $W_s$ of the sleeve, a magnetized width $W_M$ of the main pole, a magnetized width $W_c$ of the catch pole, and a width $W_B$ of the magnetic brush satisfy $W_S>W_M>W_B>W_C$.

16 Claims, 5 Drawing Sheets

DEVELOPING UNIT AND IMAGE FORMING APPARATUS EMPLOYING THE SAME

CROSS-REFERENCE TO RELATED APPLICATIONS

This application claims priority under 35 U.S.C. §119(a) from Korean Patent Application No. 10-2007-0055629, filed on Jun. 7, 2007 in the Korean Intellectual Property Office, the disclosure of which is incorporated herein in its entirety by reference.

BACKGROUND OF THE INVENTION

1. Field of the Invention

The present general inventive concept relates to a bi-component type developing unit and an image forming apparatus employing the same, and more particularly, to a developing unit having a configuration to prevent a leak of developer and an image forming apparatus employing the same.

2. Description of the Related Art

In general, a bi-component type developing unit includes a developer made of a toner for forming an image and a carrier for carrying the toner by a magnetic force, a developing member which separates the toner from the developer and forms a toner image on a photosensitive medium, a regulation blade which regulates an amount of the supplied developer, and a sealing member which prevents a leak of the developer.

In addition, the developing member includes a magnetic cylinder provided with a plurality of magnetic poles and a sleeve rotatably installed on a circumference of the magnetic cylinder. Here, the magnetic poles include a catch pole which enables developer to be adsorbed onto a circumference of the sleeve, a main pole which contributes to developing, a returning pole which carries the carrier remaining on the circumference of the sleeve after contributing to a developing, and an exfoliation pole which separates the returned carrier from the surface of the sleeve.

FIG. 1 is a graph illustrating an interrelation of a magnetized width, a sleeve width, and a sealing width of a magnetic cylinder of a conventional developing unit, and FIG. 2 is a graph illustrating a distribution of a magnetic force in an axial direction of the magnetic cylinder with respect to magnetic intensities of 120 (mT), 130 (mT), and 140 (mT) of the conventional developing unit illustrated in FIG. 1.

Referring to FIG. 1, a magnetized width $W_1$ of each of a plurality of magnetic poles 1 which form the magnetic cylinder is the same, and it is the same as a width $W_2$ of a magnetic brush corresponding to an area of a sleeve 3 contributing to toner developing. A sealing member 5 is formed between end parts 3*a* and 3*b* of the sleeve 3 in a transverse direction and the width $W_2$ of the magnetic brush to prevent a leak of the developer to opposite sides of the developing member. Also, a regulation blade 7 is formed to have a same width as that of the sleeve 3.

Meanwhile, if the developing unit is disposed as described above, combined magnetic force A or C at the opposite end parts of the sleeve 3 is larger than a magnetic force B at a center part thereof by an edge effect generated at opposite end parts of the magnetic cylinder as illustrated in FIG. 2. Accordingly, more developer is picked up at the opposite end parts of the developing member than at a center part of the developing member.

As described above, if the developer is increased at the opposite end parts of the developing member, a load to seal the developer at the sealing member provided at opposite end parts is increased, thereby causing the leak of the developer.

In addition, since an amount of the developer fed through the opposite end parts of the magnetic cylinder increases more than at the center part, the developer positioned in a developing gap at the opposite end parts of the magnetic cylinder is pressed and more stagnant than at the center part.

The amount of the carrier passing from the opposite end parts of the developing member to the photosensitive medium increases due to such stagnancy, and as a result, a total amount of the developer in the developing unit is decreased. In this case, an amount of a supplied developer picked up by an auger and supplied to the developing member decreases, thereby causing a non-uniform image, such as a mark. Also, toner scattering increases due to a decrease of an amount of the carrier charging the toner, to thereby contaminate an inside of the developing unit.

In addition, since the carrier carried to the photosensitive medium has a relatively larger volume in comparison with the toner, the carrier is caught in a cleaning blade of the photosensitive medium, or passes through the blade to be caught between the photosensitive medium and a charging roller, thereby accelerating scratch and abrasion of a surface of the photosensitive medium. Accordingly, as printing continues, the amount of the developer decreases, and a state incapable of performing printing due to damage of the surface of the photosensitive medium comes earlier, and accordingly, there arises a problem of reducing a lifetime of the developing unit and an image forming apparatus employing the same.

SUMMARY OF THE INVENTION

The present general inventive concept provides a developing unit having a configuration to prevent a leak of a developer and to prevent a carrier from being supplied to a photosensitive medium and an image forming apparatus employing the same by preventing the developer from being supplied more at opposite end parts of a developing member than at a center part thereof.

Additional aspects and utilities of the present general inventive concept will be set forth in part in the description which follows and, in part, will be obvious from the description, or may be learned by practice of the present general inventive concept.

The foregoing and/or other aspects of the present general inventive concept can be achieved by providing a developing unit which forms an image on a photosensitive medium, including a housing which accommodates a developer, a magnetic cylinder having a catch pole which picks up the developer in the housing by a magnetic force, and a main pole to hold a carrier among the picked-up developer, a sleeve rotatably installed on a circumference of the magnetic cylinder to form a magnetic brush having a predetermined width on the circumference by the developer picked up by the catch pole, and a sealing member provided at opposite end parts in an axial direction of the sleeve to prevent a leak of the developer, wherein a width $W_s$ of the sleeve, a magnetized width $W_M$ of the main pole, a magnetized width $W_c$ of the catch pole, and a width $W_B$ of the magnetic brush satisfy condition 1:

$$W_S > W_M > W_B > W_C \qquad \text{<Condition 1>}$$

The magnetic cylinder may further include at least one returning pole which returns the developer remaining on the circumference of the sleeve after the developer is supplied to the photosensitive medium to the inside of the housing, and an exfoliation pole which exfoliates the returned developer from the circumference of the sleeve.

A magnetized width $W_R$ of the at least one returning pole may satisfy condition 2:

$$W_S > W_R > W_B \quad \text{<Condition 2>}$$

A magnetized width $W_P$ of the exfoliation pole may satisfy condition 3:

$$W_S > W_P > W_B \quad \text{<Condition 3>}$$

A magnetized width $W_P$ of the exfoliation pole may satisfy condition 4.

$$W_S > W_P > W_B \quad \text{<Condition 4>}$$

The developer may include a toner, and the carrier comprises a magnetic carrier to carry the toner.

The developing unit may further include a regulation blade provided in a position facing the catch pole to regulate a height of the developer on the circumference of the sleeve.

The foregoing and/or other aspects of the present general inventive concept can also be achieved by providing an image forming apparatus, including a photosensitive medium, a charging member which charges the photosensitive medium, an exposure unit which exposes the photosensitive medium and forms an electrostatic latent image, a developing unit to form a visible image corresponding to the electrostatic latent image on the photosensitive medium, the developing unit including a housing to accommodate a developer, a magnetic cylinder having a catch pole to pick up the developer and a main pole to hold a carrier of the picked-up developer, a sleeve rotatably installed on a circumference of the magnetic cylinder to form a magnetic brush having a predetermined width on the circumference by the developer picked up by the catch pole, and a sealing member provided at opposite end parts in an axial direction of the sleeve to prevent a leak of the developer, wherein a width $W_s$ of the sleeve, a magnetized width $W_M$ of the main pole, a magnetized width $W_c$ of the catch pole, and a width $W_B$ of the magnetic brush satisfy a condition of $W_S > W_M > W_B > W_C$, a transfer unit which transfers an image formed in the developing unit to a printing medium, and a fusing unit which fuses the image transferred to the printing medium.

The magnetic cylinder may further include at least one returning pole which returns the developer remaining on the circumference of the sleeve after the developer is supplied to the photosensitive medium to the inside of an housing and an exfoliation pole which exfoliates the returned developer from the circumference of the sleeve.

A magnetized width $W_R$ of the at least one returning pole may satisfy condition 2.

$$W_S > W_R > W_B \quad \text{<Condition 2>}$$

A magnetized width $W_P$ of the exfoliation pole may satisfy condition 3.

$$W_S > W_P > W_B \quad \text{<Condition 3>}$$

A magnetized width $W_P$ of the exfoliation pole may satisfy condition 4.

$$W_S > W_P > W_B \quad \text{<Condition 4>}$$

The developer may include a toner, and the carrier comprises a magnetic carrier to carry the toner.

The image forming apparatus further includes a regulation blade provided in a position facing the catch pole to regulate a height of the developer on the circumference of the sleeve.

The image forming apparatus may further include a cleaning unit which removes the developer remaining on the photosensitive medium.

The foregoing and/or other aspects of the present general inventive concept can also be achieved by providing a developing roller usable with a developing unit of an image forming apparatus, the developing roller including a magnetic cylinder comprising a plurality of magnetic poles to form a magnetic brush, and a sleeve rotatably disposed to surround the magnetic cylinder and to define a first area where the magnetic brush is formed and a second transfer area at end parts of the sleeve where the magnetic brush is not formed, wherein the plurality of magnetic poles have at least two different magnetic widths such that an amount of developer to form the magnetic brush is uniform along the first area.

The plurality of magnetic poles may include a catch pole to attract developer to the sleeve and a main pole to selectively hold a carrier of the developer while allowing a toner of the developer to be supplied to a photosensitive medium of the image forming apparatus, and a magnetized width $W_c$ of the catch pole is less than a magnetized width $W_M$ of the main pole.

The foregoing and/or other aspects of the present general inventive concept can also be achieved by providing a developing unit to develop a latent image on a photosensitive medium, the developing unit including a housing to hold a developer, a developing roller, including a magnetic cylinder having a catch pole to pick up the developer and a main pole to hold a carrier of the picked-up developer and a sleeve rotatably installed on a circumference of the magnetic cylinder to form a magnetic brush having a predetermined width with the picked up developer, and a sealing member provided at opposite end parts of the sleeve to prevent a leak of the developer through the end parts, wherein a magnetized width $W_M$ of the main pole is greater than a magnetized width $W_c$ of the catch pole, and a width $W_B$ of the magnetic brush corresponds to the magnetized width $W_c$ of the catch poles such that an amount of developer on the magnetic brush is uniform.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
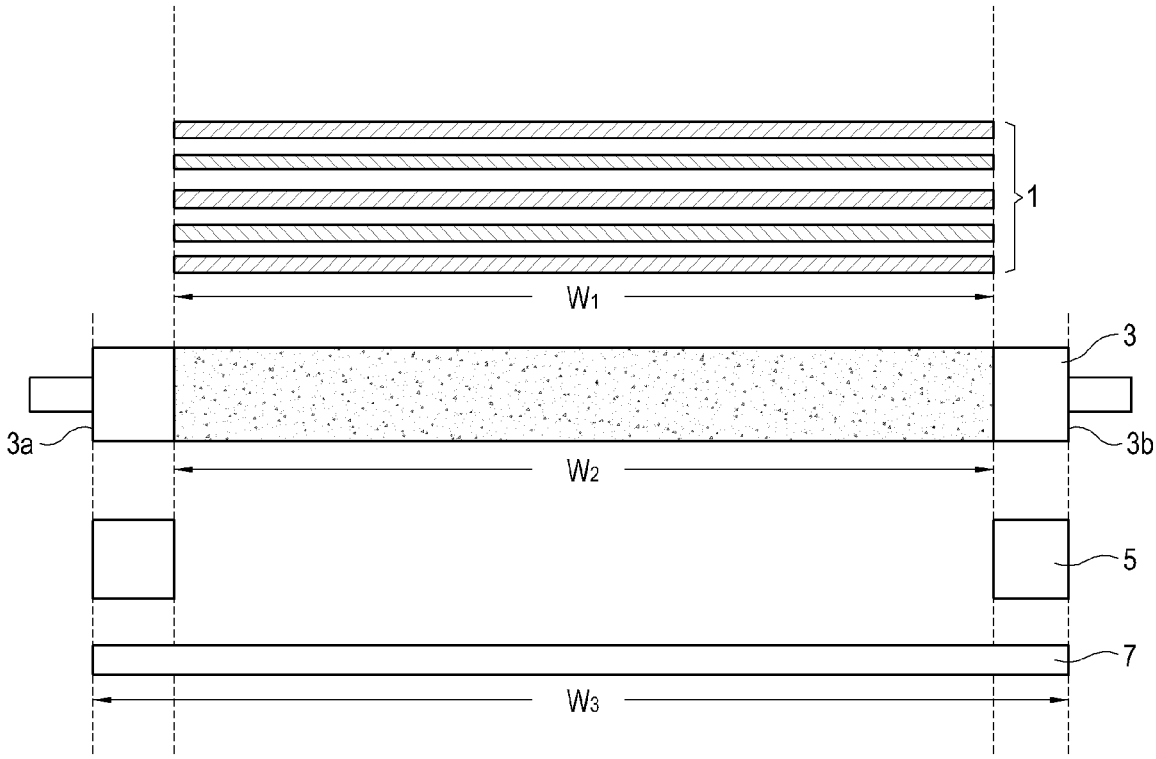
FIG. 1 is a graph illustrating an interrelation of a magnetized width, a sleeve width, and a sealing width of a magnetic cylinder of a conventional developing unit.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 3:
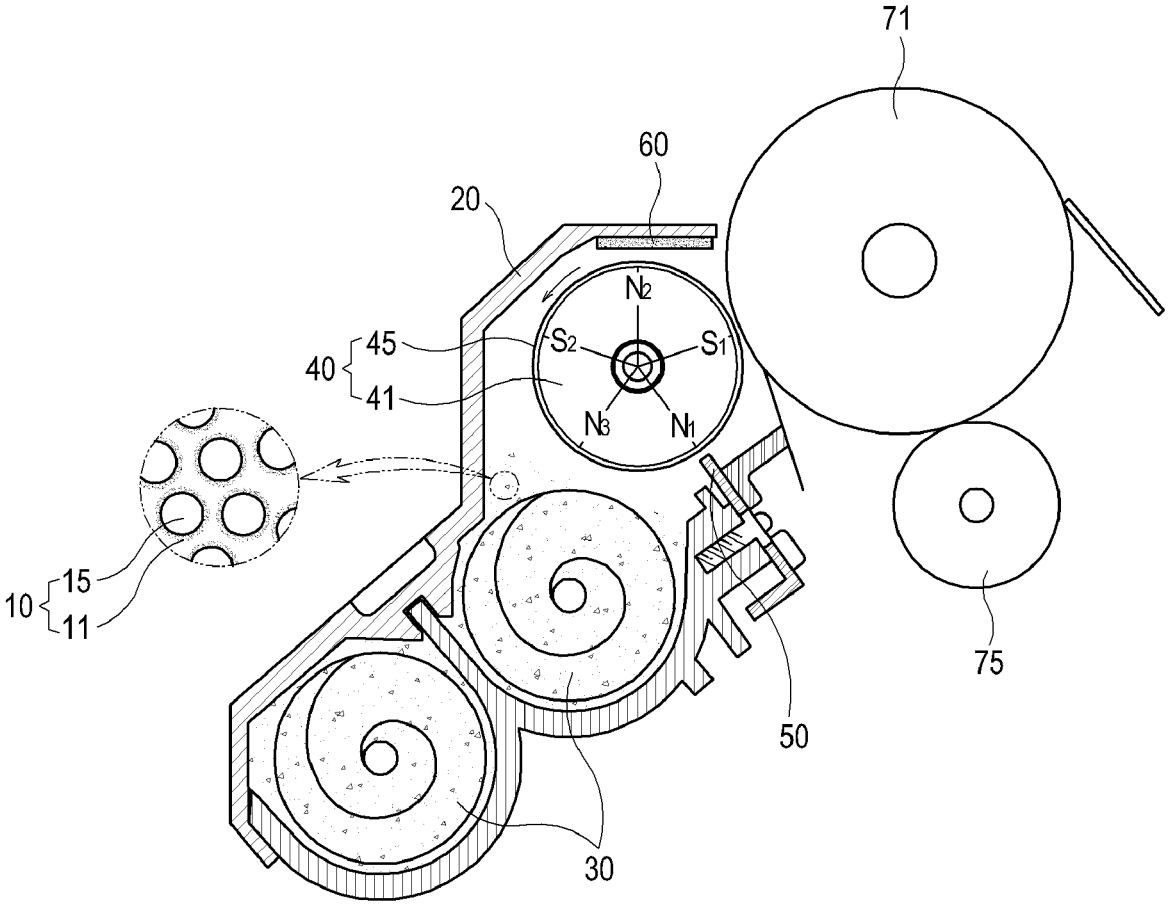
FIG. 3 is a schematic view illustrating a developing unit according to an exemplary embodiment of the present general inventive concept.

FIG. 3 is a schematic view illustrating a developing unit according to an exemplary embodiment of the present general inventive concept.

As illustrated in FIG. 3, a developing unit according to the present general inventive concept may include a housing 20 which accommodates a developer 10, a developing member 40 which forms an image in a photosensitive medium 71, which is charged by a charging member 75 to form a latent image by an exposure, and a sealing member 60 which prevents a leak of the developer 10.

An inside of the housing 20 may further include an auger 30. The auger 30 uniformly supplies the developer 10 accommodated in the housing 20 to the developing member 40.

The developer 10 may be provided as a bi-component system including a predetermined color of toner 11 and a carrier 15 to carry the toner 11. The carrier 15 can be a magnetic substance having magnetism to carry the toner 11 from an inside of the housing 20 toward the photosensitive medium 71. The toner 11 and the carrier 15 can be moved by a rotation of the auger 30, and can have a predetermined electric potential of a charged amount from a friction during their movement. The toner 11 is adsorbed to a circumference of the carrier 15 by the frictional charge, and is supplied to the developing member 40 with the carrier 15.

The developing member 40 may include a magnetic cylinder 41 having a catch pole $N_1$ and a main pole $S_1$, and a sleeve 45 rotatably installed on a circumference of the magnetic cylinder 41. The sleeve 45 can be disposed at a predetermined interval from the photosensitive medium 71.

The catch pole $N_1$ picks up the developer 10, that is, the carrier 15 and the toner supplied through the auger 30, by a magnetic force, and enables the same to be adsorbed to the circumference of the sleeve 45.

At this time, a magnetic brush 47 (see FIG. 4) having a predetermined width is formed on the circumference of the sleeve 45 by the developer picked up by the catch pole $N_1$. A width of the magnetic brush 47 is determined by a magnetized width of a plurality of magnetic poles making up the magnetic cylinder 41. In particular, the width of the magnetic brush 41 is greatly affected by the magnetized width and an intensity of the magnetic force of the catch pole $N_1$.

The main pole $S_1$ is a magnetic pole disposed within the magnetic cylinder 41 to face the photosensitive medium 71, and enables the carrier 15 in the developer adsorbed on the circumference of the sleeve 45 to remain coupled to the circumference of the sleeve 45. Accordingly, the toner 11 charged with a predetermined electric potential is supplied to the photosensitive medium 71 by a potential difference between the sleeve 45 and the photosensitive medium 71.

The magnetic cylinder 41 may further include at least one of returning poles $N_2$ and $S_2$, and an exfoliation pole $N_3$. FIG. 3 exemplifies a first returning pole $N_2$ and a second returning pole $S_2$ as the returning poles. The first returning pole $N_2$ and the second returning pole $S_2$ return the developer 10 which remains on the circumference of the sleeve 45 after developer was supplied to the photosensitive medium 71 to the inside of the housing 20, and more particularly, the carrier 15 to the inside of the housing 20. The exfoliation pole $N_3$ is provided between the returning poles $N_2$ and $S_2$ and the catch pole $N_1$ to enable the returned developer to be separated from the circumference of the sleeve 45 to the inside of the housing 20.

Also, the developing unit according to an exemplary embodiment may further include a regulation blade 50 provided in a position facing the catch pole $N_1$ to regulate a height of the developer picked up onto the circumference of the sleeve 45. The regulation blade 50 can be disposed at a predetermined interval with respect to the sleeve 45. Accordingly, the developer adsorbed to the sleeve 45 by the catch pole $N_1$ is regulated in a uniform amount while passing through the interval between the regulation blade 50 and the sleeve 45 with the rotation of the sleeve 45.

The sealing member 60 can be provided at opposite end areas in an axial direction of the sleeve 45 to prevent the leak of the developer 10 accommodated inside the housing 20. That is, the sealing member 60 contacts with the opposite end parts of the sleeve 45 in which the magnetic brush 47 is not formed, and seals the opposite side walls of the housing 20, thereby preventing the leak of the developer.

FIG. 3 illustrates that in forming the magnetic cylinder 41, magnetic poles of a part facing the developer in the catch pole $N_1$, the main pole $S_1$, and the first and the second returning pole $N_2$ and $S_2$, and the exfoliation pole $N_3$ are arranged as north (N) pole, south (S) pole, N pole, S pole, and N pole, respectively. However, the present general inventive concept is not limited to the arrangement and the number of the returning poles exemplified, and various changes may be made in these embodiments without departing from the principles and spirit of the present general inventive concept.

In the developing unit with the above-described configuration, a larger combined magnetic field may be formed at opposite end parts of the magnetic cylinder 41 by an edge effect of the magnetic field than at a center part thereof, and more developer may be picked up at the end parts than in the center part. Meanwhile, as illustrated in FIG. 4, if the magnetized width of each of the magnetic poles forming the magnetic cylinder 41 is regulated, the amount of the developer can be uniform on an entire width of the magnetic brush 47.

Figure 4:
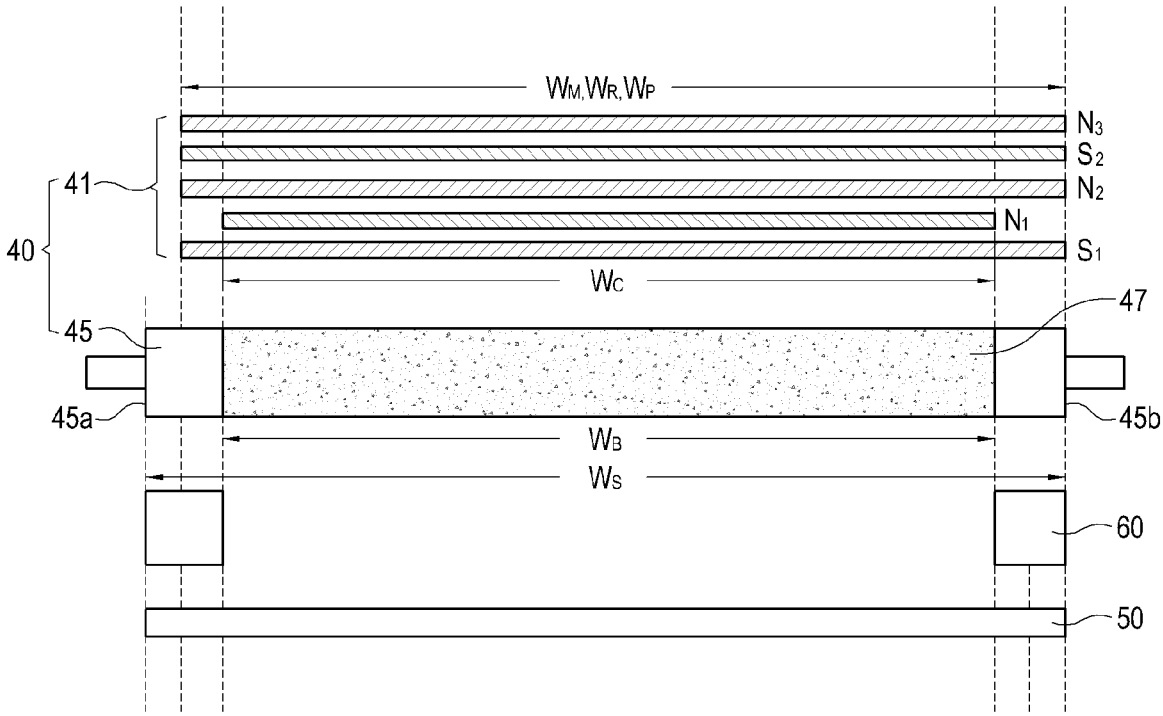
FIG. 4 illustrates an interrelation of a magnetized width, a sleeve width, a magnetic brush width, and a sealing width of a magnetic cylinder according to an exemplary embodiment of the present general inventive concept.

FIG. 4 illustrates an interrelation of a magnetized width, a sleeve width, a magnetic brush width, and a sealing width of the magnetic cylinder 41 of the developing unit according to an exemplary embodiment of the present general inventive concept.

As illustrated in FIG. 4, the magnetized width of each of the plurality of magnetic poles satisfies a condition 1 for a relation of a width of the sleeve 45 and the magnetic brush 47.

$$W_S > W_M > W_B > W_C \qquad \text{[Condition 1]}$$

Here, $W_S$ denotes the width of the sleeve 45, $W_M$ denotes a magnetized width of the main pole S1, $W_B$ denotes a width of the magnetic brush 47, and $W_C$ denotes a magnetized width of the catch pole $N_1$.

Figure 2:
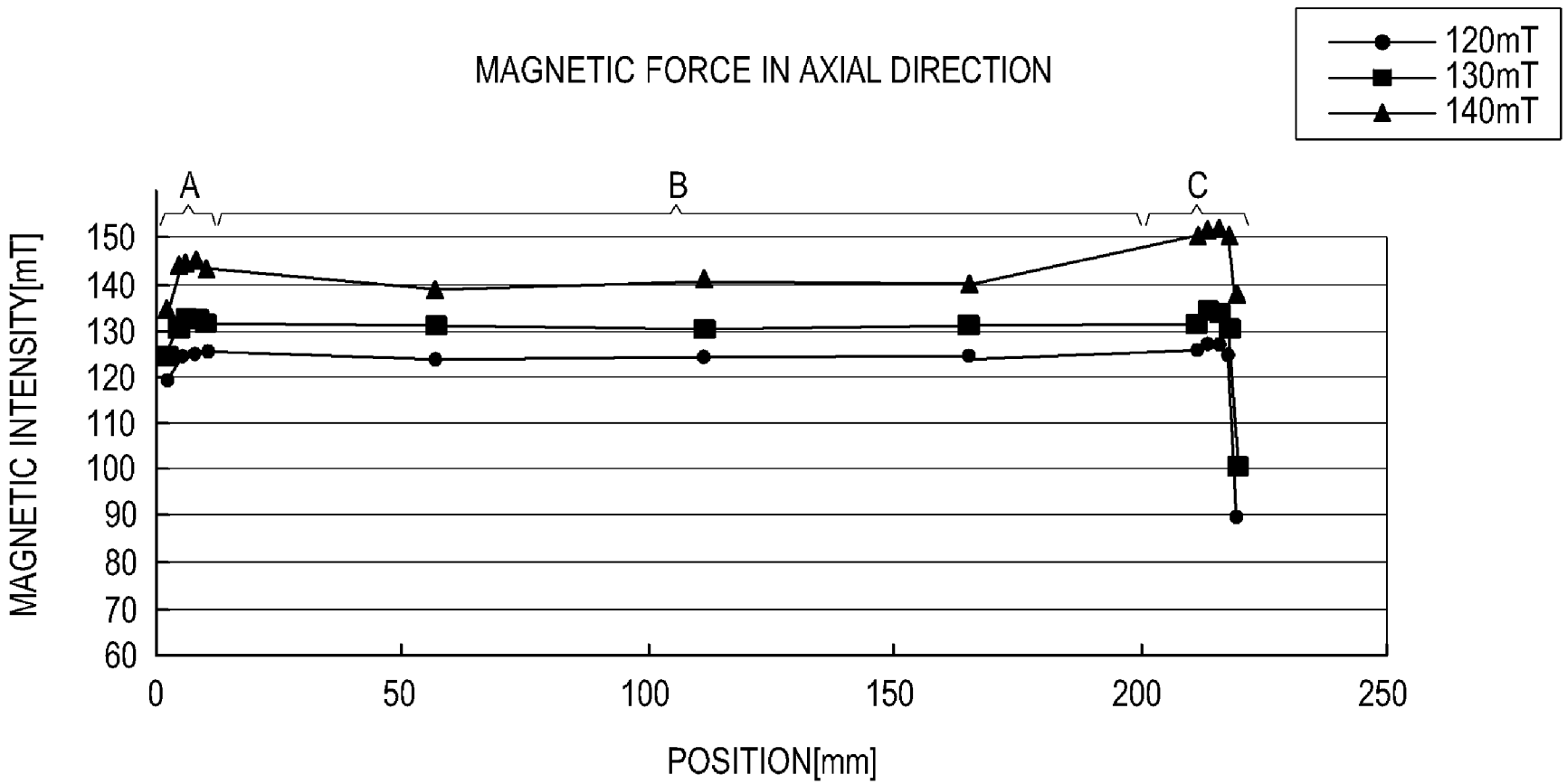
FIG. 2 is a graph illustrating a distribution of a magnetic force in an axial direction of the magnetic cylinder of a conventional developing unit illustrated in FIG. 1.

As illustrated in condition 1, if the magnetized width $W_M$ of the main pole $S_1$ is longer than the width $W_B$ of the magnetic brush, the magnetic brush 47 is not affected by the magnetic edge effect generated at the opposite end parts of the magnetized width of the main pole $S_1$. That is, although a magnetic force characteristic of the magnetic cylinder 41 in an axial direction appears as illustrated in FIG. 2, the part affected by the magnetic edge effect is positioned outside the width of the magnetic brush. Therefore, within the width $W_B$ of the magnetic brush, there is no magnetic edge effect of the magnetic cylinder 41.

Meanwhile, an amount of the developer picked up from the catch pole $N_1$ onto the sleeve 45 can be made uniform at the opposite end parts and the center part of the sleeve 45 by making the magnetized width $W_C$ of the catch pole $N_1$ same or shorter than the width $W_B$ of the magnetic brush in a configuration of the magnetic cylinder 41 picking up the developer through the catch pole $N_1$.

Accordingly, an amount and a height of the magnetic brush 47 regulated while passing through the regulation blade 50 can be uniform, and the load to seal the developer caught in the sealing member 60 can be uniform along a direction in the width $W_B$ of the magnetic brush 47.

Also, in the developing unit according to an exemplary embodiment of the present general inventive concept, a magnetized width $W_R$ of the returning poles $N_2$ and $S_2$ can satisfy a condition 2.

$$W_S > W_R > W_B \quad \text{[Condition 2]}$$

Also, in the developing unit according to an exemplary embodiment of the present general inventive concept, a magnetized width $W_P$ of the exfoliation pole $N_3$ can satisfy a condition 3.

$$W_S > W_P > W_B \quad \text{[Condition 3]}$$

As illustrated in conditions 2 and 3, if each of the magnetized width $W_R$ of the returning poles $N_2$ and $S_2$, and the magnetized width $W_P$ of the exfoliation pole $N_3$ are longer than the width $W_B$ of the magnetic brush 47, which are illustrated to have the same length as the magnetized width $W_M$ of the main pole in FIG. 4, the magnetic brush 47 may be less affected by the magnetic edge effect of the opposite end parts of the magnetized width of the magnetic cylinder 41 in comparison with a case satisfying only condition 1.

In addition, the sealing member 60 is formed between end parts 45*a* and 45*b* and the width $W_B$ of the magnetic brush 47 in a transverse direction to the sleeve 45. Also, the regulation blade 50 is formed to have a same width as the width $W_S$ of the sleeve 45.

Hereinafter, an operating process of the developing unit with the above-described configuration according to the exemplary embodiment will be described.

The developer positioned inside the housing 20 is supplied to the developing member 40 by the auger 30. Frictional charging arises between the toner 11 and the carrier 15 of the developer 10 during the supplying process, and accordingly, the toner 11 adsorbs to the circumference of the carrier 15.

The developer supplied to the developing member 40 is picked up by the catch pole $N_1$, and adsorbs to the circumference of the sleeve 45. At this time, the magnetized width $W_C$ of the catch pole $N_1$ is the same or smaller as/than the width $W_B$ of the magnetic brush 47. The developer is adsorbed on the circumference of the sleeve 45 in a width direction to correspond to the magnetized width $W_C$ of the catch pole $N_1$. The developer adsorbed in this way is regulated by the regulation blade 50, and only the developer having a layer height corresponding to an interval formed between the sleeve 45 and the regulation blade 50 passes through the interval. The developer having passed through the interval moves to a developing position in which the main pole $S_1$ is provided by the rotation of the sleeve 45. In the developing position, the toner in the developer moves from the circumference of the sleeve 45 to the photosensitive medium 71 by a static electricity formed between the photosensitive medium 71 and the developing member 40 to form a visible image on the photosensitive medium 71.

Here, the developing member 40 and the photosensitive medium 71 can be separated by a developing gap, and in the present general inventive concept, the amount of the developer adsorbed to the circumference of the sleeve 45 by the magnetic cylinder 41 is uniform in the center part and the opposite end parts in the transverse direction. Therefore, a greater supply of the developer at the opposite end parts can be prevented, and thus, the supply of the carrier 15 at the opposite end parts to the photosensitive medium 71 can be prevented. Accordingly, a carrier can be prevented from being wasted and the photosensitive medium 71 can be prevented from being damaged by clogging of the carrier. The developer including the carrier 15 and the remaining toner 11 passed the developing position passes the returning poles $N_2$ and $S_2$ with the rotation of the sleeve 45 to separate from the circumference of the sleeve 45 at a position of the exfoliation pole $N_3$ and is returned and accommodated inside the housing 20. Accordingly, the developing process is continuously performed by repeatedly performing the above-described process.

Figure 5:
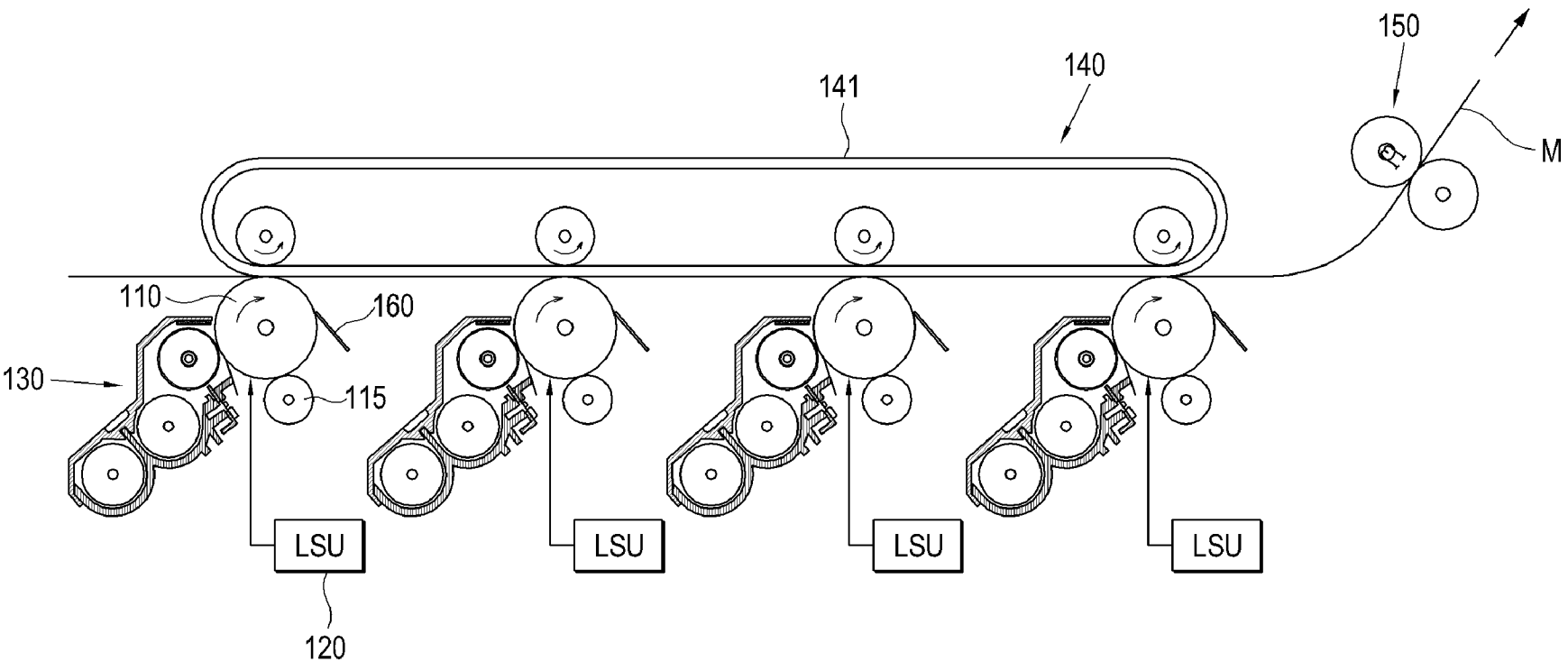
FIG. 5 is a schematic view illustrating an image forming apparatus according to an exemplary embodiment of the present general inventive concept.

FIG. 5 is a schematic sectional view illustrating an image forming apparatus according to an exemplary embodiment of the present general inventive concept.

As illustrated in FIG. 5, an image forming apparatus according to an exemplary embodiment of the present general inventive concept may include a photosensitive medium 110, a charging member 115 which charges the photosensitive medium 110, an exposure unit 120 which forms an electrostatic latent image on the photosensitive medium 110, a developing unit 130 which develops a visible image with respect to the electrostatic latent image formed in the photosensitive medium 110, a transfer unit 140 which transfers the visible image formed in the developing unit 130 on a printing medium M, and a fusing unit 150 which fuses the visible image transferred on the printing medium M. Also, the image forming apparatus may further include a cleaning unit 160 which cleans toner remaining on the photosensitive medium 110 after transferred.

Here, FIG. 5 illustrates a tandem type color image forming apparatus. The photosensitive medium 110, the charging member 115, the exposure unit 120, and the developing unit 130 are provided plurality for respective colors along a feeding path of the printing medium M. However, the present general inventive concept is not limited thereto, and other arrangements of developing units, photosensitive mediums, and transfer units are possible.

The exposure unit 120 can be provided as a light scanning unit (LSU) which scans a light beam corresponding to each color to the photosensitive medium 110 to form an electrostatic latent image on the photosensitive medium 110 charged to a predetermined electric potential by the charging member 115.

The developing unit 130 supplies a toner to the photosensitive medium 110, and forms the visible image corresponding to the latent image. The developing unit 130 forms a toner image with a bi-component development type, and has the same configuration as the developing unit according to the exemplary embodiment of the present general inventive concept described above with reference to FIGS. 3 and 4. Therefore, a detailed description of the developing unit will be omitted.

The transfer unit 140 is disposed to face a plurality of photosensitive media 110 across the printing medium M fed through the feeding path to transfer the toner image formed in the photosensitive media 110 to the printing medium M which is being fed. For this purpose, the transfer unit 140 may include a transfer belt 141 disposed to face the plurality of photosensitive media 110.

The fusing unit 150 fuses the image transferred to the printing medium M on the printing medium M by applying pressure and heat to the passing printing medium M.

The developing unit with the above-described configuration according to the exemplary embodiment of the present general inventive concept prevents an edge effect of the magnetic cylinder 41, to thereby enable the developer to be uniformly adsorbed in a transverse direction of the magnetic brush. Accordingly, a developer is prevented from being supplied more at the opposite end parts of the developing member than in the center part of the developing member, thereby preventing a leak of the developer and the supply of the carrier toward the photosensitive media. Accordingly, a lifetime of the developer and the developing unit can be extended.

Also, the image forming apparatus employing the above-described developing unit has an advantage to solve a pollution and damage problem of the photosensitive media due to a carrier leak, and to form a uniform image. Also, it prevents a lifetime reduction problem of the developer due to the leak of the carrier and a breakage of the developing unit to thereby save a product upkeep cost.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing unit which forms an image on a photosensitive medium, comprising:

a housing which accommodates a developer;

a magnetic cylinder having a catch pole which picks up the developer in the housing by a magnetic force, and a main pole to hold a carrier among the picked-up developer;

a sleeve rotatably installed on a circumference of the magnetic cylinder to form a magnetic brush having a predetermined width on the circumference by the developer picked up by the catch pole; and a sealing member provided at opposite end parts in an axial direction of the sleeve to prevent a leak of the developer, wherein a width Ws of the sleeve, a magnetized width WM of the main pole, a magnetized width Wc of the catch pole, and a width WB of the magnetic brush satisfy condition 1:

$$W_S>W_M>W_B>W_C. \quad \text{<Condition 1>}$$

2. The developing unit according to claim 1, wherein the magnetic cylinder further comprises:

at least one returning pole which returns the developer remaining on the circumference of the sleeve after the developer is supplied to the photosensitive medium to the inside of the housing; and an exfoliation pole which exfoliates the returned developer from the circumference of he sleeve.

3. The developing unit according to claim 2, wherein a magnetized width $W_R$ of the at least one returning pole satisfies condition 2:

$$W_S>W_R>W_B. \quad \text{<Condition 2>}$$

4. The developing unit according to claim 2, wherein a magnetized width $W_p$ of the exfoliation pole satisfies condition 4:

$$W_S>W_P>W_B. \quad \text{<Condition 4>}$$

5. The developing unit according to claim 3, wherein a magnetized width $W_p$ of the exfoliation pole satisfies condition 3:

$$W_S>W_P>W_B. \quad \text{<Condition 3>}$$

6. The developing unit according to claim 1, wherein the developer comprises a toner, and the carrier comprises a magnetic carrier to carry the toner.

7. The developing unit according to claim 1, further comprising:

a regulation blade provided in a position facing the catch pole to regulate a height of the developer on the circumference of the sleeve.

8. An image forming apparatus, comprising:

a photosensitive medium;

a charging member which charges the photosensitive medium;

an exposure unit which exposes the photosensitive medium and forms an electrostatic latent image;

a developing unit to form a visible image corresponding to the electrostatic latent image on the photosensitive medium, the developing unit comprising:

a housing to accommodate a developer, a magnetic cylinder having a catch pole to pick up the developer and a main pole to hold a carrier of the picked-up developer, a sleeve rotatably installed on a circumference of the magnetic cylinder to form a magnetic brush having a predetermined width on the circumference by the developer picked up by the catch pole, and a sealing member provided at opposite end parts in an axial direction of the sleeve to prevent a leak of the developer, wherein a width $W_s$ of the sleeve, a magnetized width $W_M$ of the main pole, a magnetized width $W_c$ of the catch pole, and a width $W_B$ of the magnetic brush satisfy a condition of $W_S>W_M>W_B>W_C$;

a transfer unit which transfers an image formed in the developing unit to a printing medium; and a fusing unit which fuses the image transferred to the printing medium.

9. The image forming apparatus according to claim 8, wherein the magnetic cylinder further comprises:

at least one returning pole which returns the developer remaining on the circumference of the sleeve after the developer is supplied to the photosensitive medium to an inside of the housing; and an exfoliation pole which exfoliates the returned developer from the circumference of the sleeve.

10. The image forming apparatus according to claim 9, wherein a magnetized width $W_R$ of the at least one returning pole satisfies condition 2:

$$W_S>W_R>W_B. \quad \text{<Condition 2>}$$

11. The image forming apparatus according to claim 9, wherein a magnetized width $W_P$ of the exfoliation pole satisfies condition 4:

$$W_S>W_p>W_B. \quad \text{<Condition 4>}$$

12. The image forming apparatus∩according to claim 10, wherein a magnetized width $W_p$ of the exfoliation pole satisfies condition 3:

$$W_S>W_P>W_B. \quad \text{<Condition 3>}$$

13. The image forming apparatus according to claim 8, wherein the developer comprises a toner, and the carrier comprises a magnetic carrier to carry the toner.

14. The image forming apparatus according to claim 8, further comprising:

a regulation blade provided in a position facing the catch pole to regulate a height of the developer on the circumference of the sleeve.

15. The image forming apparatus according to claim 8, further comprising:

a cleaning unit which removes the developer remaining on the photosensitive medium.

16. A developing roller usable with a developing unit of an image forming apparatus, the developing roller comprising:

a magnetic cylinder comprising a plurality of magnetic poles to form a magnetic brush; and a sleeve rotatably disposed to surround the magnetic cylinder and to define a first area where the magnetic brush is formed and a second transfer area at end parts of the sleeve where the magnetic brush is not formed, wherein the plurality of magnetic poles have at least two different magnetic widths such that an amount of developer to form the magnetic brush is uniform along the first area, and wherein the plurality of magnetic poles comprise:

a catch pole to attract developer to the sleeve; and a main pole to selectively hold a carrier of the developer while allowing a toner of the developer to be supplied to a photosensitive medium of the image forming apparatus;

wherein a width $W_S$ of the sleeve, a magnetized width $W_M$ of the main pole, a magnetized width $W_C$ of the catch pole, and a width $W_B$ of the magnetic brush satisfy condition 1:

$$W_S > W_M > W_B > W_C. \quad \text{<Condition 1>}$$

* * * * *